US005330397A

United States Patent [19]

Prince et al.

[11] Patent Number: 5,330,397

[45] Date of Patent: Jul. 19, 1994

[54] LINEAR TRACKING ISOKINETIC EXERCISER

[75] Inventors: Jeffrey T. Prince, Grass Valley; Glen R. Mangseth, El Dorado Hills; Malcolm L. Bond, Davis; John Bouwman, Vacaville; Philip T. Dempster, St. Helena, all of Calif.

[73] Assignee: Loredan Biomedical, Inc., West Sacramento, Calif.

[21] Appl. No.: 110,347

[22] Filed: Aug. 20, 1993

Related U.S. Application Data

[63] Continuation of Ser. No. 473,281, Jan. 31, 1990, abandoned.

[51] Int. Cl.[5] ..... A63B 24/00

[52] U.S. Cl. ..... 482/7; 482/53; 482/80; 482/113; 482/900; 73/379.09; 601/35

[58] Field of Search ..... 482/1, 4–8, 482/51–53, 57, 71–73, 80, 111–113, 900–903; 128/25 R, 25 B; 73/379.01, 379.09; 417/441, 471; 188/312, 313, 318

[56] References Cited

U.S. PATENT DOCUMENTS

| | | | |
|---|---|---|---|
| 3,364,736 | 1/1968 | Bathurst et al. | 482/900 X |
| 3,529,474 | 9/1970 | Olson et al. | 482/113 X |
| 4,496,147 | 1/1985 | DeCloux et al. | 482/53 |
| 4,550,908 | 11/1985 | Dixon | 128/25 R |
| 4,681,316 | 7/1987 | DeCloux | 482/113 |
| 4,691,694 | 9/1987 | Boyd et al. | 482/900 X |
| 4,733,858 | 3/1988 | Lan | 482/53 |
| 4,907,797 | 3/1990 | Gezari et al. | 482/900 X |
| 4,911,430 | 3/1990 | Flament | 482/71 |
| 4,919,418 | 4/1990 | Miller | 482/902 X |
| 4,958,830 | 9/1990 | Huggins et al. | 482/52 X |

*Primary Examiner*—Richard J. Apley
*Assistant Examiner*—Joe H. Cheng
*Attorney, Agent, or Firm*—Townsend and Townsend Khourie and Crew

[57] ABSTRACT

A recumbent bilateral reciprocal isokinetic leg exerciser wherein first and second reciprocating members are slidingly coupled to a linear track so that they move with linear bilateral reciprocal motion. Both reciprocating members are coupled to associated hydraulic cylinders so that hydraulic fluid is drawn into or forced out of the hydraulic cylinders as the reciprocating members move along the track. A valve assembly is coupled to the hydraulic cylinders for controlling fluid flow into and out of the hydraulic cylinders so that the reciprocating members move isokinetically. The valve assembly may be set for simultaneous movement of the first and second reciprocating members or for movement of one reciprocating member by itself. To ensure accurate measurement of patient effort, a strain gauge assembly is disposed on each reciprocating member for detecting deformation of the reciprocating member along multiple axes. The information obtained by the strain gauge assembly then may be used to calculate the actual forces being applied in a desired direction.

11 Claims, 5 Drawing Sheets

LINEAR TRACKING ISOKINETIC EXERCISER

This is a continuation of application Ser. No. 07/473,281, filed Jan. 31, 1990, now abandoned.

BACKGROUND OF THE INVENTION

This invention relates generally to exercise and rehabilitation systems and methods, and, more specifically, to a linear tracking isokinetic exerciser.

When the hip, thigh, knee or ankle are injured, rehabilitation includes increasing the range of motion of the affected joint as well as increasing muscle strength and endurance. It is also necessary to retrain normal gait characteristics, particularly with regard to symmetrical strength and movement of both limbs. Thus, physicians and physical therapist have become increasingly interested in multi-joint exercises that simulate the dynamics of actual limb movement.

U.S. Pat. No. 3,784,194 illustrates a known exercise device for bilaterally and reciprocally exercising a person's limbs. A person using the exerciser sits on an upright seat and places each of his or her feet through a loop of a pedal. The pedals are secured to a forward end of an L-shaped lever located on each side of the exerciser, and the levers are coupled to an actuator which isokinetically controls the motion of the levers. Although useful in many respects, the device lacks some desirable features. For example, the upright seat makes exercising awkward and inefficient. The reciprocating peddles move arcuately and therefore do not properly simulate the forces encountered during actual walking. Movement of one limb inherently causes a corresponding movement in the other limb, so the device cannot isolate and exercise a single limb at a time. Analog hydraulic pressure gauges are used to measure the forces generated by each leg, but the indirect nature of the measurement only approximates the actual force being applied to the pedals. The needles in the gauges are not damped, so they bounce severely under even moderate use. Thus, unless gross differences exist between limbs, the gauges do not provide sufficient information for adequate gait or strength training.

SUMMARY OF THE INVENTION

The present invention is directed to an isokinetic limb exerciser wherein pedal motion is linear, and the limbs may be exercised alone or in combination. Forces are measured at the point of application and in such a manner that forces applied in any particular direction may be isolated.

In one embodiment of the invention directed to a recumbent bilateral reciprocal isokinetic leg exerciser, first and second reciprocating members are slidingly coupled to a linear track so that they move with linear bilateral reciprocal motion. Both reciprocating members are coupled to associated hydraulic cylinders so that hydraulic fluid is drawn into or forced out of the hydraulic cylinders as the reciprocating members move along the track. A valve assembly is coupled to the hydraulic cylinders for controlling fluid flow into and out of the hydraulic cylinders so that the reciprocating members move isokinetically. The valve assembly may be set for simultaneous movement of the first and second reciprocating members or for movement of one reciprocating member by itself. To ensure accurate measurement of patient effort, a strain gauge assembly is disposed on each reciprocating member for detecting deformation of the reciprocating member along multiple axes. The information obtained by the strain gauge assembly then may be used to calculate the actual forces being applied in a desired direction.

DETAILED DESCRIPTION OF THE PREFERRED EMBODIMENTS

Figure 1:
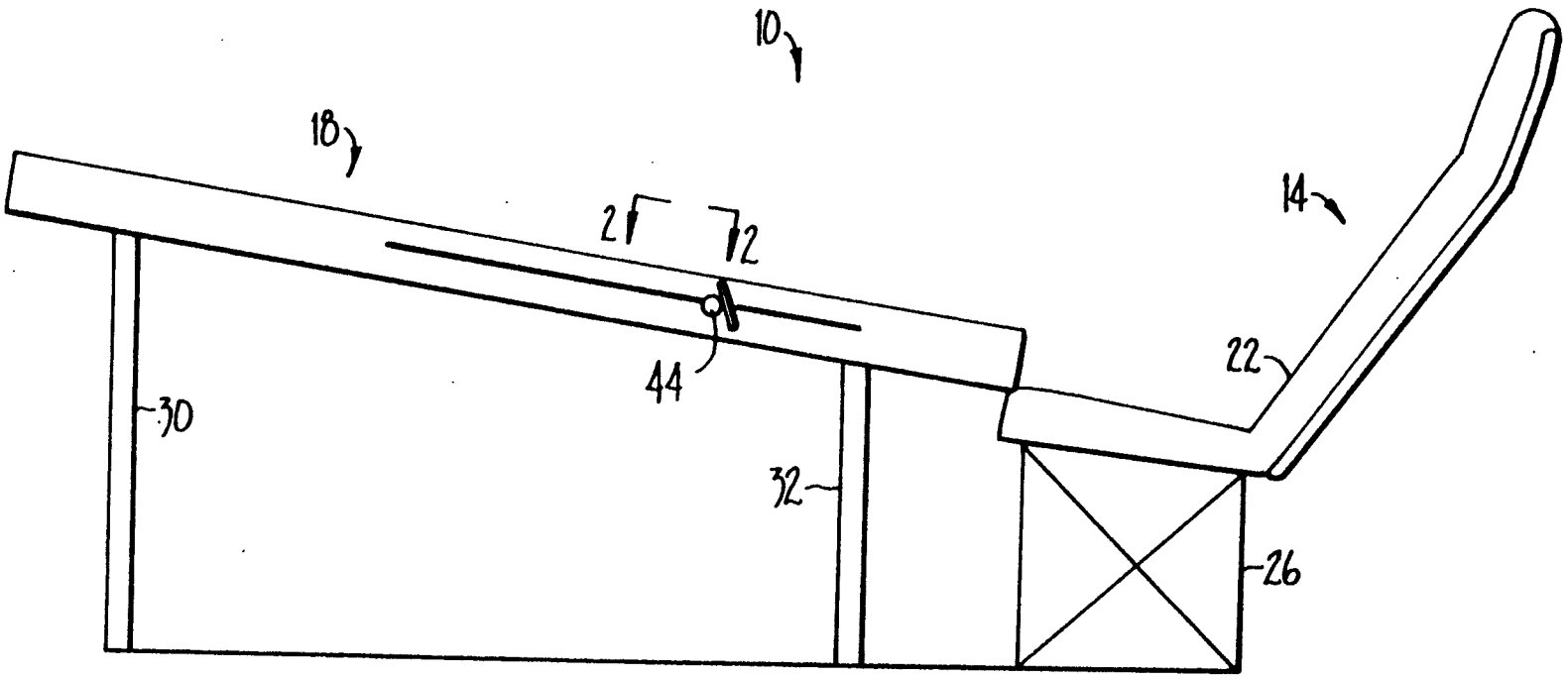
FIG. 1 is a perspective view of a particular embodiment of a recumbent exercise device according to the present invention.
Figure 2:
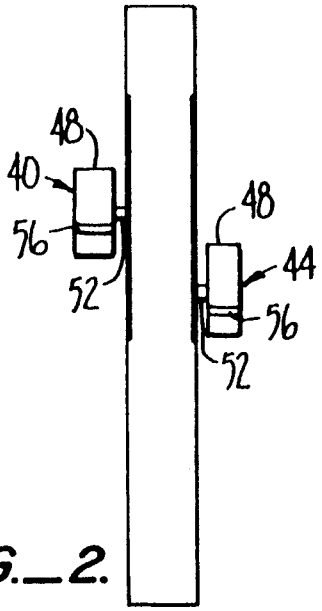
FIG. 2 is a view of the track assembly taken along line 2—2 of FIG. 1.

FIG. 1 is a diagram of a recumbent exercise system 10 according to the present invention. Exercise system 10 includes a seating assembly 14 and a track assembly 18. Seating assembly 14 includes a cushioned seat 22 supported on a base 26 and is oriented to allow a patient to be seated in a recumbent position. Track assembly 18 is supported on base members 30, 32 which may or may not be coupled to base 26. As shown in FIGS. 1 and 2, track assembly 18 includes first and second reciprocating members 40 and 44, respectively, located on opposite sides thereof. Each reciprocating member may include a pedal 48 attached to a shaft 52. A strap 56 may be provided for maintaining the user's foot against the pedal 48.

Figure 3:
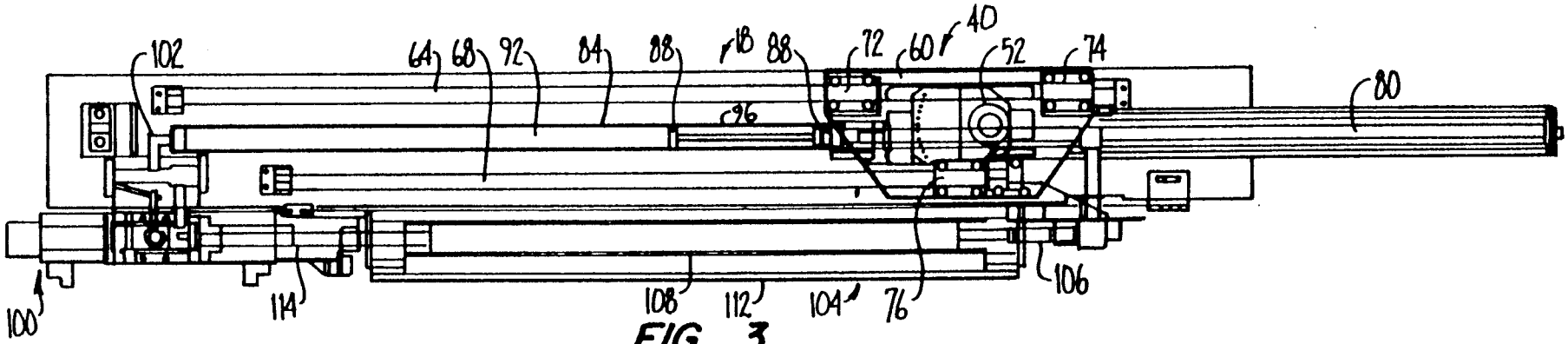
FIG. 3 is a more detailed view of the track assembly shown in FIG. 1.

FIG. 3 is a more detailed diagram of track assembly 18. As shown in FIG. 3, shaft 52 of reciprocating member 40 is mounted to a frame 60 which is slidingly mounted to tracks 64 and 68 via bearings 72, 74 and 76. Pedal 48 is not shown for clarity. Frame 60 is further coupled to a piston rod 80 which is part of a hydraulic cylinder 84. A piston 88 disposed within hydraulic cylinder 84 separates hydraulic cylinder 84 into a valve chamber 92 and an accumulator chamber 96. Valve chamber 92 is in fluid communication with a valve assembly 100 through a passage 102, whereas accumulator chamber 96 is in fluid communication with an accumulator assembly 104 through a passage 106. Reciprocating member 44 is structured in the same way, except that a single accumulator assembly 104 serves both reciprocating members.

Accumulator assembly 104 comprises a flexible container or bladder 108 disposed within a housing 112. Bladder 108 is fluidly coupled to accumulator chamber 96 through passage 106 and to valve assembly 100 through a passage 114. Housing 112 may be pressurized so that the hydraulic fluid stored within bladder 108 is under constant pressure. As a result, piston 88 is biased toward the valve assembly 100 to provide a default position for the reciprocating members.

Figure 4:
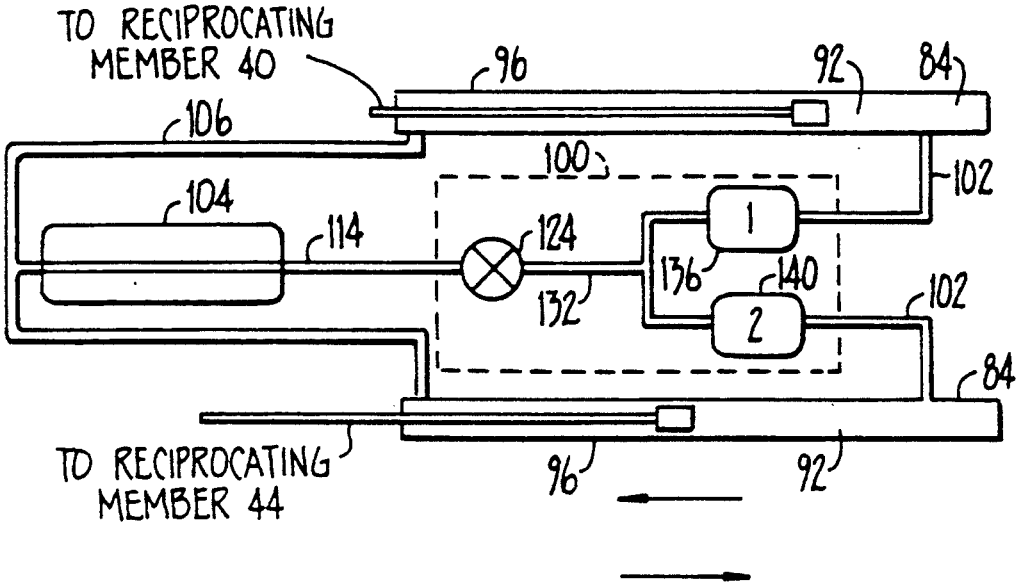
FIG. 4 is a hydraulic circuit diagram for the track assembly shown in FIG. 1.

FIG. 4 is a hydraulic circuit diagram for the present invention. As shown in FIG. 4, the accumulator chambers 96 of each hydraulic cylinder 84 are in fluid communication with each other and with accumulator assembly 104 through passage 106. The accumulator assembly 104 is also fluidly coupled to an accumulator valve 124 (within valve assembly 100) through passage 114. Accumulator valve 124 selectively couples passage 114 to a passage 132 which, in turn, is fluidly coupled to a first regulator assembly 136 and a second regulator assembly 140 within valve assembly 100. First regulator assembly 136 selectively couples passage 132 with the passage 102 leading to valve chamber 92 associated with reciprocating member 40. Similarly, second regulator assembly 140 selectively couples passage 132 with the passage 102 leading to valve chamber 92 associated with second reciprocating member 44. First regulator assembly 136 and second regulator assembly 140 operate to control the rate of fluid flow from and to valve chambers 92 so that first and second reciprocating members 40 and 44 move isokinetically.

From inspection of FIG. 4, it will be appreciated that, when accumulator valve 124 is closed and first and second regulator assemblies 136, 140 are regulating, then fluid flows out of chamber 92 associated with reciprocating member 40 and into chamber 92 associated with reciprocating member 44 when reciprocating member 40 is depressed, and vice versa. As a result, reciprocal movement will occur between first reciprocating member 40 and second reciprocating member 44. When accumulator valve 124 is open and first and second regulator assemblies 136, 140 are regulating, then first reciprocating member 40 and second reciprocating member 44 operate independently of each other at the velocities set by their associated regulators. When accumulator valve 124 is open and first regulator assembly 136 is shut off, then, if second regulator assembly 140 is regulating, first reciprocating member 40 is in a substantially locked state, and second reciprocating member 44 is free to move isokinetically. Similarly, if accumulator valve 124 is open and second regulator assembly 140 is shut off, then, if first regulator assembly 136 is regulating, second reciprocating member 44 is substantially in a locked position and first reciprocating member 40 is free to move isokinetically. When both first and second regulator assemblies 136 and 140 are shut off, then both first and second reciprocating members 40 and 44 are in substantially locked positions.

Figure 5:
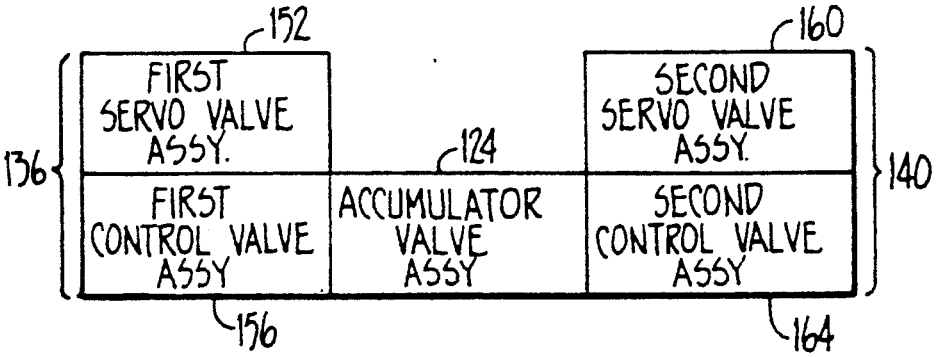
FIG. 5 is a block diagram showing a particular embodiment of a hydraulic valve assembly according to the present invention.

FIG. 5 is a block diagram showing how the regulator and valve assemblies are constructed and physically located in this embodiment. First regulator assembly 136 comprises a first servo valve assembly 152 disposed adjacent to a first control valve assembly 156. Similarly, second regulator assembly 140 comprises a second servo valve assembly 160 disposed adjacent to a second control valve assembly 164. First control valve assembly 156 and second control valve assembly 164 are disposed adjacent to and on opposite sides of accumulator valve assembly 124.

Figure 6:
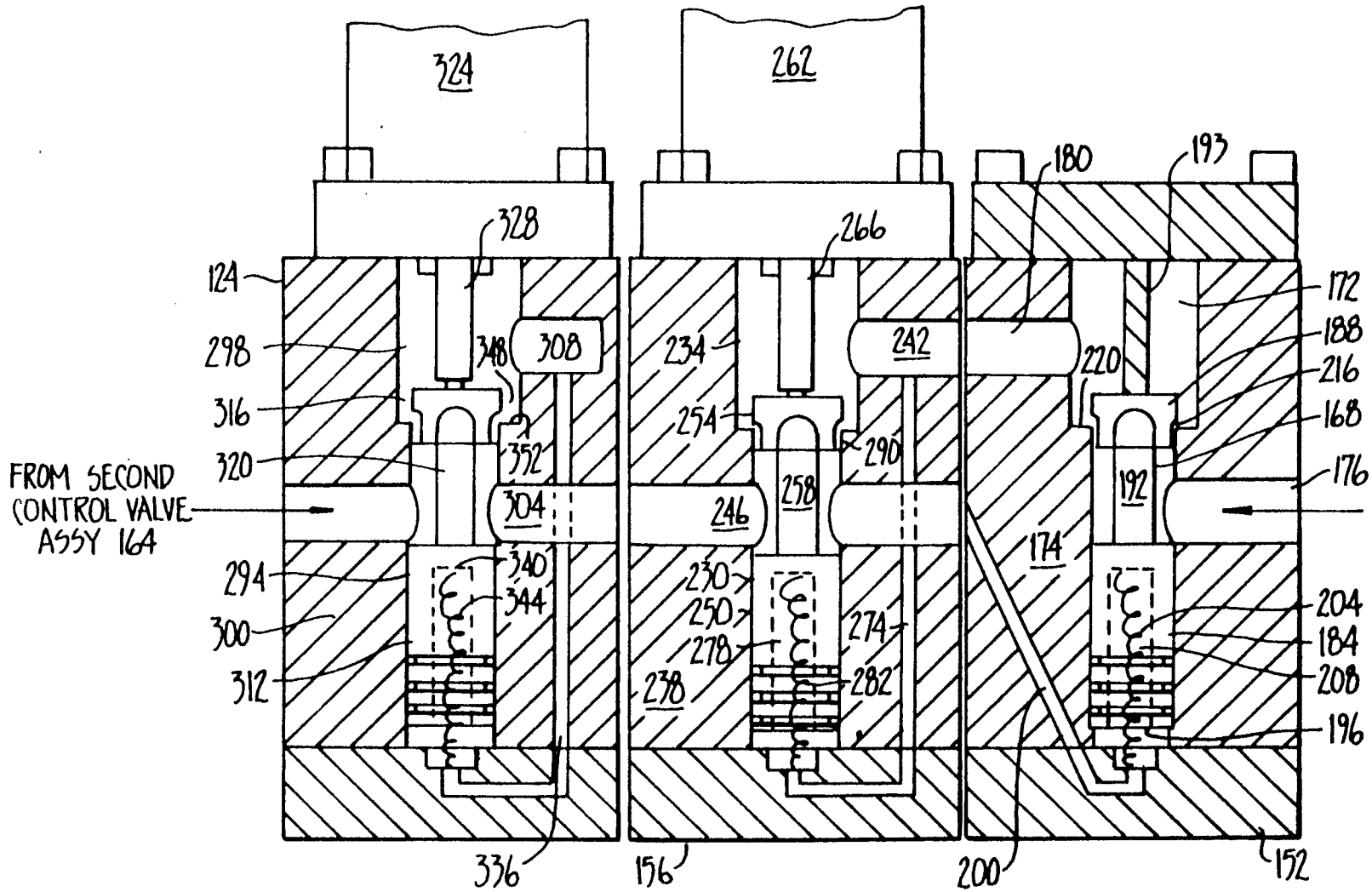
FIG. 6 is a cross-sectional diagram of particular embodiments of hydraulic accumulator, control, and servo valve assemblies according to the present invention.

FIG. 6 is a cross-sectional diagram of accumulator valve assembly 124, first servo valve assembly 152, and first control valve assembly 156. Second servo valve assembly 160 and second control valve assembly 164 are constructed in the same way, so a detailed discussion of them is omitted. First servo valve assembly 152 includes a first servo valve spool 168 fitted within a first servo valve bore 172 formed in a first servo valve body 174. First servo valve bore 172 is in fluid communication with a first servo valve fluid inlet passage 176 and a first servo valve fluid outlet passage 180. First servo valve fluid inlet passage 176 is in fluid communication with the valve chamber 92 associated with reciprocating member 40 via passage 102 (FIG. 4).

First servo valve spool 168 includes a first servo valve spool piston portion 184 and a first servo valve spool seating portion 188 which is coupled to and spaced apart from first servo valve spool piston portion 184 by a first servo valve spool connecting rod 192. First servo valve spool piston portion 184 is sealingly fitted within first servo valve bore 172 and terminates in a free end 196. The portion of first servo valve bore 172 adjacent to free end 196 is in fluid communication with a servo valve pressure coupling passage 200 for reasons discussed below. First servo valve spool piston portion 184 includes a cavity 204 in which is disposed a spring 208 for biasing first servo valve spool seating portion 188 against an abutment 193. First servo valve seating portion 188 includes a servo valve seat contact portion 216 for contacting a servo valve seat 220 formed by valve body 174. It should be apparent that when first servo valve spool 168 is in the position shown in FIG. 6, then fluid flows relatively freely from first servo valve fluid inlet passage 176 to first servo valve fluid outlet passage 180. On the other hand, when first servo valve seat contact portion 216 is contacting servo valve seat 220, fluid flow between first servo valve fluid inlet passage 176 and first servo valve fluid outlet passage 180 is inhibited. First servo valve spool seating portion 188 is shaped so that the cross-sectional flow area created by first servo valve spool seating portion 188 and first servo valve bore 172 increases as the first servo valve seat contact portion 216 moves progressively away from first servo valve seat 220.

First control valve assembly 156 includes a first control valve spool 230 fitted within a first control valve bore 234 formed within a first control valve body 238. First control valve bore 234 is in fluid communication with a first control valve fluid inlet passage 242 and a first control valve fluid outlet passage 246. First control valve fluid inlet passage 242 is in fluid communication with first servo valve fluid outlet passage 180. First control valve fluid outlet passage 246 is in fluid communication with servo valve pressure coupling passage 200 for coupling the hydraulic pressure in first control valve outlet passage 246 to the free end 196 of first servo valve spool piston portion 184 for reasons discussed below.

First control valve spool 230 includes a first control valve spool piston portion 250 and a first control valve spool seating portion 254 which is coupled to and spaced apart from first control valve spool piston portion 250 by a first control valve spool connecting rod 258. A control valve solenoid 262 is coupled to the upper portion of first control valve body 238. Control valve solenoid 262 includes a control valve solenoid plunger 266 which extends into first control valve bore 234 toward first control valve spool seating portion 254.

First control valve spool piston portion 250 is sealingly fitted within first control valve bore 234 and terminates in a free end 270. The portion of first control valve bore 234 adjacent to free end 270 is in fluid communication with a control valve pressure equalizing passage 274 which, in turn, is in fluid communication with first control valve fluid inlet passage 242. Control valve pressure equalizing passage 274 assures that there is no net hydraulic bias on first control valve spool 230.

First control valve piston portion 250 also includes a cavity 278 within which is disposed a spring 282 for biasing first control valve spool seating portion 254 against first control valve solenoid plunger 266.

First control valve spool seating portion 254 includes a control valve seat contact portion 286 for contacting a control valve seat 290 formed by valve body 238. Additionally, first control valve spool seating portion 254 is shaped so that the cross-sectional flow area created by first control valve spool seating portion 254 and first control valve bore 234 increases as the first control valve seat contact portion 286 moves progressively away from first control valve seat 290. As a result, fluid flow between first control valve inlet passage 242 and first control valve outlet passage 246 is inhibited when first control valve seat contact portion 286 contacts first control valve seat 290, and then fluid flow gradually increases as first control valve seat contact portion 286 moves away from first control valve seat 290.

Accumulator valve assembly 124 includes an accumulator valve spool fitted within an accumulator valve bore 298 formed within an accumulator valve body 300. Accumulator valve bore 298 is in fluid communication with an accumulator valve fluid inlet passage 304 and an accumulator valve fluid outlet passage 308. Accumulator valve fluid inlet passage is in fluid communication with first control valve fluid outlet passage 246. Additionally, accumulator valve fluid inlet passage 304 is in fluid communication with the second control valve outlet passage (not shown) in second control valve assembly 164. Accumulator valve fluid outlet passage 308 is in fluid communication with accumulator 104 via passage 128 (FIG. 4).

Accumulator valve spool 294 includes an accumulator valve spool piston portion 312 and an accumulator valve spool seating portion 316 that is coupled to and spaced apart from accumulator valve spool piston portion 312 by an accumulator valve spool connecting rod 320. An accumulator valve solenoid 324 is coupled to the upper portion of accumulator valve body 300. Accumulator valve solenoid 324 includes an accumulator valve solenoid plunger 328 which extends into accumulator valve bore 298 toward accumulator valve spool seating portion 316.

Accumulator valve spool piston portion 312 is sealingly fitted within accumulator valve bore 298 and terminates in a free end 332. The portion of accumulator valve bore 298 adjacent to free end 332 is in fluid communication with an accumulator valve pressure equalizing passage 336 which, in turn, is in fluid communication with accumulator valve fluid outlet passage 308. Accumulator valve pressure equalizing passage 336 insures that there is no net hydraulic bias on accumulator valve spool 294. Accumulator spool piston portion 312 further includes a cavity 340 within which is disposed a frame 344 for biasing accumulator valve spool seating portion 316 against accumulator valve solenoid plunger 328.

Accumulator valve spool seating portion 316 includes an accumulator valve seat contact portion 348 for contacting an accumulator valve seat 352 formed by accumulator valve body 300. Thus, fluid flow between accumulator valve input passage 304 and accumulator valve outlet passage 308 is inhibited when accumulator valve seat contact portion 48 contacts accumulator valve seat 352, whereas fluid flows relatively freely between accumulator valve fluid inlet passage 304 and accumulator valve fluid outlet passage 308 when accumulator valve seating portion 316 is in the position shown.

In operation, accumulator valve solenoid 324 positions accumulator valve spool 294 in the open or closed position depending on whether or not fluid flow is to be allowed between first and second regulating assemblies 136, 140 and accumulator 104 as discussed above. First control valve assembly 156 (and second control valve assembly 164) set the basic fluid flow rate for the desired isokinetic velocity. To do this for first reciprocating member 40, control valve solenoid 262 is activated so that a selected position of first control valve spool 230 is correspondingly set. Where control valve solenoid plunger 266 (and hence control valve spool 230) is positioned depends on the desired isokinetic velocity, since velocity is determined by the rate of fluid flow through the valves. The lower the desired velocity, the closer first control valve seat contact portion 286 is to control valve seat 290.

The rate of fluid flow between first control valve fluid inlet passage 242 and first control valve fluid outlet passage 246 depends on the pressure of the fluid in first control valve inlet passage 242 as well as the cross-sectional orifice area formed by first control valve seating portion 254 and control valve seat 290. Thus, to insure isokinetic operation it is necessary to accommodate for fluid pressure differences caused by the varying amounts of force applied to first and second reciprocating members 40 and 42 by the patient. That is the function of first servo valve assembly 152 (and second servo valve assembly 160). When hydraulic pressure increases at first servo valve inlet passage 176, a pressure differential occurs relative to the free end of first servo valve spool 168. This occurs because of servo valve pressure coupling passage 200 which is coupled to first control valve outlet passage 246. Consequently, a net downward force is exerted on first servo valve spool 168. This causes the first servo valve seat contact portion 216 to approach first servo valve seat 220, thus decreasing flow between first servo valve fluid inlet passage 176 and first servo valve fluid outlet passage 180. The reduced fluid flow therefore compensates for the increased pressure, and isokinetic velocity is maintained.

Figure 7:
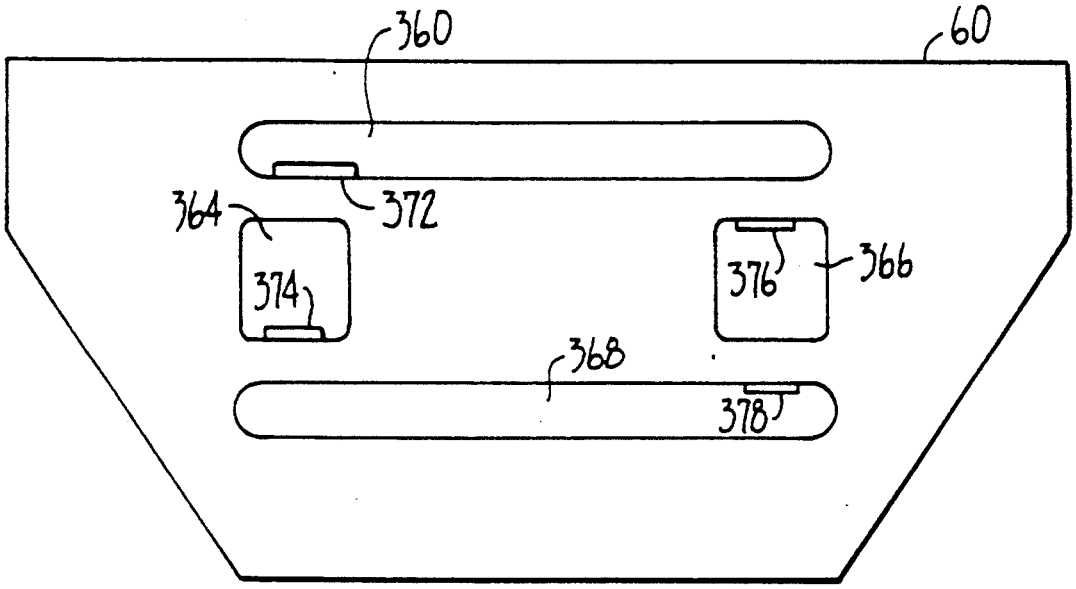
FIG. 7 is a diagram of a particular embodiment of an apparatus according to the present invention for measuring force applied by the user to a frame member of the recumbent exercise device.

Another important feature of the present invention is the technique used for detecting and calculating force applied to the first and second reciprocating members by the patient. Rather than sensing hydraulic pressure as is done in conventional devices, force is detected at the point of application, and a signal indicating the force applied in a particular direction (e.g., along the axis of the track) is provided to the user. This is accomplished by using the strain gauge assembly shown in FIG. 7. As shown in FIG. 7, frame 60 is provided with a plurality of apertures 360–368 with a corresponding plurality of strain gauges 372–378 located as shown. By locating the strain gauges in this manner, the amount of deformation of frame 60 along dissimilar axes, and hence the forces applied to frame 60 in any direction, may be calculated.

While the above is a complete description of a preferred embodiment of the present invention, various modifications may be employed. For example, the hydraulic actuating mechanisms disclosed herein may be replaced with the active motor-controlled system disclosed in copending application Ser. No. 07/866,112, now U.S. Pat. No. 5,244,441, which is a continuation of application Ser. No. 07/472,399, now abandoned entitled "Position Based Motion Controller" incorporated herein by reference. Consequently, the scope of the invention should not be limited, except as described in the claims.

What is claimed is:

1. An exercise apparatus comprising:

a guide having an axis;

a first reciprocating member slidingly coupled to the guide;

a second reciprocating member slidingly coupled to the guide;

wherein the first and second reciprocating members slide along the axis of the guide;

wherein the first and second reciprocating members are slidingly coupled to the guide for alternately reciprocating movement relative to each other; and isokinetic means, coupled to the first and second reciprocating members, for moving the first and second reciprocating members isokinetically in response to a force applied by a user to the first and second reciprocating members, the isokinetic means comprising:

first fluid compression means, coupled to the first reciprocating member, for compressing a fluid in response to the force applied by the user to the first reciprocating member;

second fluid compression means, coupled to the second reciprocating member, for compressing the fluid in response to the force applied by the user to the second reciprocating member; and fluid flow regulating means, in fluid communication with the first and second fluid compression means, for controlling fluid flow from the first and second fluid compression means for moving the first and second reciprocating members when the user applies the force to the first or second reciprocating member;

wherein the fluid flow regulating means comprises:

a first servo valve assembly having a first servo valve spool fitted within a first servo valve bore, the first servo valve bore having a first servo valve fluid inlet in fluid communication with the first fluid compression means and a first servo valve fluid outlet, the first servo valve spool being capable of moving between a first servo spool position, wherein fluid flows between the first servo valve fluid inlet and the first servo valve fluid outlet through a first servo valve orifice area defined by the servo valve spool and a servo valve seat, and a second servo spool position, wherein fluid flows between the first servo valve fluid inlet and the first servo valve fluid outlet through a second servo orifice area defined by the first servo valve spool and the servo valve seat, the second servo orifice area being less than the first servo orifice area;

velocity setting means for selecting an isokinetic velocity value for the first and second reciprocating members; and first servo valve control means, coupled to the first servo valve assembly and to the velocity setting means, for controlling the position of the first servo valve spool so that fluid flows between the first servo valve fluid inlet and the first servo fluid valve outlet at a constant rate.

2. The apparatus according to claim 1 wherein the first servo valve control means comprises a first control valve assembly having a first control valve spool fitted within a first control valve bore, the first control valve bore having a first control valve fluid inlet in fluid communication with the first servo valve outlet and a first control valve fluid outlet, the first control valve spool being capable of moving between a first control spool position, wherein fluid flows between the first control valve fluid inlet and the first control valve fluid outlet through a first control valve orifice area defined by the first control valve spool and a first control valve seat, and a second control spool position, wherein fluid flows between the first control valve fluid inlet and the first control valve fluid outlet through a second control valve orifice area defined by the first control valve spool and the first control valve seat, the second control valve orifice area being less than the first control valve orifice area; and wherein the velocity setting means includes first control valve spool position limiting means, coupled to the velocity setting means, for limiting the first control spool position to a selected position.

3. The apparatus according to claim 2 wherein the first control valve assembly further comprises first control valve spool position maintaining means for maintaining the first control valve spool at the first control spool position.

4. The apparatus according to claim 3 wherein the first control valve spool position maintaining means comprises control valve spool biasing means for biasing the first control valve spool toward the first control spool position.

5. The apparatus according to claim 4 wherein the first control valve spool includes a first control valve spool piston portion having a free end spaced apart from the first control valve seat and sealingly fitted within the first control valve bore, and wherein the first control valve spool position maintaining means includes an equalizing passage for coupling fluid pressure from the first control valve fluid inlet to the free end of the first control valve spool piston portion.

6. The apparatus according to claim 5 wherein the fluid flow regulating means further comprises first servo valve spool positioning means for moving the first servo valve spool toward the second servo spool position when fluid pressure in the first servo valve fluid inlet increases.

7. The apparatus according to claim 6 wherein the first servo valve spool includes a first servo valve spool piston portion having a free end spaced apart from the first servo valve seat and sealingly fitted within the first servo valve bore, and wherein the first servo valve spool positioning means includes a pressure coupling passage for coupling fluid pressure from the first control valve fluid outlet to the free end of the first servo valve spool piston portion.

8. The apparatus according to claim 7 further comprising an accumulator valve assembly having an accumulator valve spool fitted within an accumulator valve bore, the accumulator valve bore having an accumulator valve fluid inlet in fluid communication with the first control valve fluid outlet and an accumulator valve fluid outlet, the accumulator valve spool being capable of moving between an open position, wherein fluid flows between the accumulator valve fluid inlet and the accumulator valve fluid outlet through an accumulator valve orifice area defined by the accumulator valve spool and an accumulator valve seat, and a closed position, wherein the accumulator valve spool abuts against the accumulator valve seat so that fluid flow between the accumulator valve fluid inlet and the accumulator valve fluid outlet is inhibited.

9. The apparatus according to claim 8 further comprising an accumulator in fluid communication with the accumulator valve fluid outlet for storing fluid flowing therefrom.

10. The apparatus according to claim 9 further comprising pressurizing means for pressurizing the fluid stored in the accumulator.

11. The apparatus according to claim 10 wherein the accumulator comprises a flexible container, and wherein the pressurizing means further comprises:

a housing for the container; and housing pressure means for pressurizing the housing.

* * * * *